United States Patent [19]

Padi

[11] Patent Number: 5,018,738

[45] Date of Patent: May 28, 1991

[54] SPHERICAL DICE WITH INTERCHANGEABLE ORIENTATION INSERT MEMBERS

[76] Inventor: Gyula Padi, 664 E. Woodington, Lancaster, Calif. 93535

[21] Appl. No.: 408,550

[22] Filed: Sep. 18, 1989

[51] Int. Cl.[5] ..... A63F 9/04

[52] U.S. Cl. ..... 273/146

[58] Field of Search ..... 273/146, 58 BA, 59 B

[56] References Cited

U.S. PATENT DOCUMENTS 3,400,932 9/1968 Conrad ..... 273/146

FOREIGN PATENT DOCUMENTS 2144999 3/1985 United Kingdom ..... 273/146

*Primary Examiner*—Edward M. Coven
*Assistant Examiner*—Valerie A. Szczepanik
*Attorney, Agent, or Firm*—Thomas I. Rozsa

[57] ABSTRACT

A die is configured in a hollow spherical configuration which is composed of two interlocked but separable hemisphere sections, and set within the hollow sphere is a hollow orientation piece having apertures within its wall and a selection member such as a ball freely movably therein. upon rolling the sphere, the selection member will randomly fall into one of the selected apertures in the internal orientation member which will thereupon cause a given portion of the surface of the sphere located 180 degrees from the selected aperture to face upwardly. If various numbers are inscribed upon the surface of the sphere, the sphere can be used as a die, with the drawn number being located at the position on the surface of the sphere opposite to the aperture of the internal orientation member into which the selection member fell.

18 Claims, 1 Drawing Sheet

SPHERICAL DICE WITH INTERCHANGEABLE ORIENTATION INSERT MEMBERS

BACKGROUND OF THE INVENTION

1. Field of the Invention

The present invention relates to game devices and more particularly a spherical dice apparatus wherein the random numbers which may turn up when a die is rolled are located on the outer surface of a sphere as opposed to the sides of a cube as is well known in a conventional die. The filed of the present invention further relates to modifications to a die to vary the method by which a random number may be turned up upon the roll of the spherical die.

2. Description of the Prior Art

The conventional and well known die is a small cube marked on each face with from one to six spots and used, usually in pairs, in various games and in gambling by being shaken and thrown to come to rest at random on a flat surface.

In general, variations on the convention die concept have been created and patented in the prior art. The following patents and patent publications are illustrated of the known prior art:

1. U.S. Pat. No. 973,595 issued to Wahlin in 1910 for "Spherical Dice".
2. U.S. Pat. No. 4,546,978 issued to David in 1985 for "Dice And Games".
3. U.S. Pat. No. 1,593,907 issued to Madan in 1925 for "Game Device".
4. U.S. Pat. No. 4,807,883 issued to Silverman in 1989 for "Game Apparatus And Dice Construction Therefor".
5. U.S. Pat. No. 4,164,351 issued to Baker in 1979 for "Die-Resembling Game Cube".
6. U.S. Pat. No. 4,682,778 issued to Willis et al in 1987 for "Political Game Utilizing Die With Interchangeable Faces".
7. U.S. Pat. No. 3,400,932 issued to Conrad in 1965 for "Lawn Dice Having Finger Holes".
8. U.S. Pat. No. 809,293 issued to Friedenthal in 1906 for "Game Apparatus".
9. German Offenlegungsschrift No. 3425 102 A1 published in 1986.

U.S. Pat. No. 3,400,932 to Conrad for "Lawn Dice Having Finger Holes" illustrates a dice with a spherical member 10 disposed therein. The dice has a hollow interior having the shape of a truncated octahedron which contains a ball having an eccentric center of gravity. This is basically a lawn die which can be rolled by hand and which will automatically right itself on one of the flat outer faces. This spherical member has an eccentric weight embedded in the surface sot hat the ball rolling around within the hollow interior will impart a wobbly or eccentric motion to the die which will not only provide entertainment for use thereof, but will render it impossible for the player to predict by expertness of rolling same which of the surfaces will come up.

U.S. Pat. No. 4,682,778 to Willis is relevant because it shows a changeable eight-sided die. The section inside the die are magnetically attached.

U.S. Pat. No. 973,595 to Wahlin for "Spherical Dice" also discloses a spherical dice. A spherical body 5 is inserted inside the ball. The spherical body is made of heavy material. The sphere also contains various recesses inside it so that the ball can fall on one of the recesses thereby causing a number on the sphere to come up.

U.S. Pat. No. 4,546,978 to David for "Dice And Games" discloses die configurations which have an outer shell in which a balanced weight is positioned. Also provided is a die construction with manual and/or chance adjustments.

U.S. Pat. No. 1,593,907 to Madan for "Game Device" discloses a die construction of interest in as much as die body 6 is disposed within die 5. The interior die rolls within the exterior die and is also transparent so that both die faces can be seen.

The U.S. Pat. No. 4,807,883 to Silverman is relevant in that it illustrated various shapes of dice in FIGS. 5, 6, 7, and 8.

U.S. Pat. No. 4,164,351 to Baker illustrated a dice assembly with a ball in it.

U.S. Pat. No. 809,293 to Friedenthal for "Game Apparatus" discloses an odd shaped piece of dice.

German Offenlegungsschrift discloses a dice having a hollow interior.

While overall the concept of having an interior rotating device is shown as described in a number of the above Patents, what is not shown is the concept of having an interchangeable internal piece which causes the circular die to land in a particular location by having a circular weight land inside the interchangeable piece. What is further not shown is the concept of an interchangeable external shell.

There is a need for the improvements of the present invention which permit games of chance to be modified in difficulty through variation of the playing piece such as the dice.

SUMMARY OF THE PRESENT INVENTION

The present invention involves a modifiable dice apparatus wherein the random change of numbers which can be rolled can be modified through modification of an internal orientation member and also through modification of the external shell.

It has been discovered, according to the present invention, that if a die is configured in a hollow spherical configuration which is composed of two interlocked but separable hemisphere sections, and set within the hollow sphere is an orientation piece having apertures within its wall and a selection member such as a ball, then upon rolling the sphere, the selection member will randomly fall into one of the selected apertures in the internal orientation member which will thereupon cause a given portion of the surface of the sphere located 180 degrees from the selected aperture to face upwardly. If various numbers are inscribed upon the surface of the sphere, the sphere can be used as a die, with the drawn number being located at the position on the surface of the sphere opposite to the aperture of the internal orientation member into which the selection member fell.

It has further been discovered, according to the present invention, that if the same external shell can be opened and different orientation members having apertures at different locations inserted, then the random selection of a number can be modified to thereby increase the difficulty and fun of a game of chance in which the spherical dice is used.

It is therefore an object of the present invention to create a novel dice apparatus in the form of a sphere, where the method by which a selected number is chosen is created by an internal orientation apparatus which is interchangeable.

It is a further object of the present invention to create a spherical dice apparatus by which the selected number is changed through a variable internal insert member.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
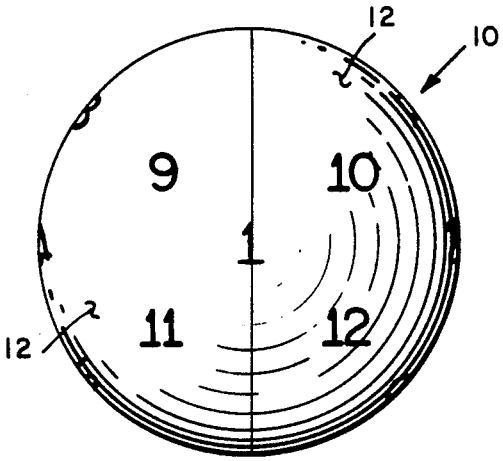
FIG. 1 is a side elevational view of the present invention spherical die, illustrating numbers 1 through 12 on a portion of the surface of the die.
Figure 2:
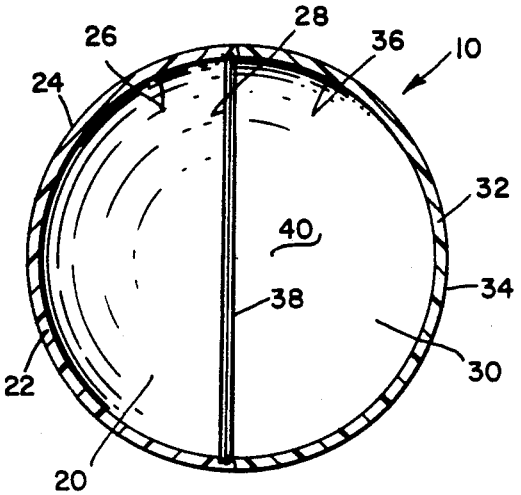
FIG. 2 is a cross-sectional view of FIG. 1, illustrating one method by which the two hemispheres of the spherical die can be separably attached together to form the hollow sphere.

Referring to FIG. 1, there is illustrated at 10 the present invention spherical die with an interchangeable orientation insert member. The surface 12 of spherical die 10 has a multiplicity of numbers thereon with the numbers 1, 9, 10, 11 and 12 fully visible while the numbers 2, 3, 4, 5, 6, 7 and 8 are partially visible. It will be appreciated that the present invention embodies the concept of any multiplicity of numbers randomly dispersed on the surface 12 of sphere 10. Referring to the cross-sectional view of FIG. 2, it can be seen that the sphere 10 is composed of two hemispheres 20 and 30. First hemisphere 20 has a shell section 22 comprising exterior surface 24 and interior surface First hemisphere 20 further comprises an interior thread 28 which extends along the entire interior surface circumference of core section 22 where first hemisphere 20 joins second hemisphere 30. Second hemisphere 30 has a shell section 32 comprising exterior surface 34 and interior surface 36. Second hemisphere 30 further comprises an exterior thread 38 which extends along the entire exterior surface circumference of core section 32. Interior thread 28 is threaded into exterior thread 38 to thereby cause the two hemispheres 20 and 30 to be joined together to form a sphere 10. It will be appreciated that the thread fit is only one alternative means by which the two sphere sections can be joined together. When thus joined, exterior surface 24 of first hemisphere 20 and exterior surface 34 of second hemisphere 30 form the exterior surface 12 of sphere 10. The formed sphere 10 has a hollow interior 40. By way of example, each hemisphere 20 and 30 can be made of plastic.

Figure 3:
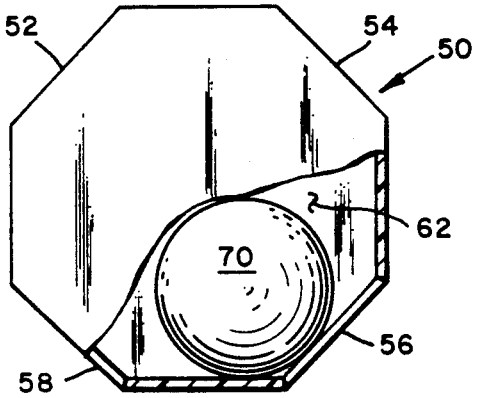
FIG. 3 is a perspective view in partial cross-section, illustrating one embodiment of an insert orientation member which is a cube with the edges cut off to form apertures, to be used with the present invention spherical die and further illustrating a ball acting as the selection member.
Figure 4:
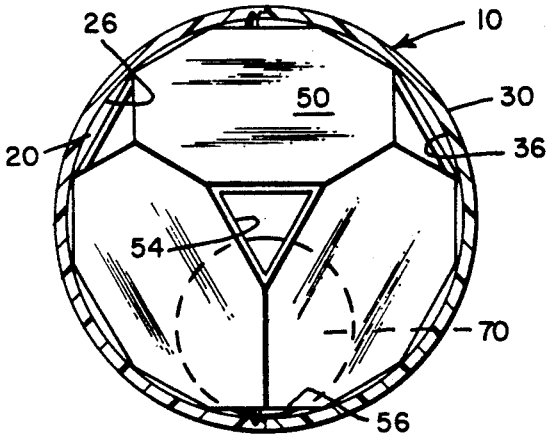
FIG. 4 is a cross-sectional view of the hollow sphere with an elevational view of the insert orientation member of FIG. 3 inserted therein, and further illustrating the selection member in dotted lines having landed in one of the apertures of the insert orientation member.

Inserted within the hollow formed sphere 10 is an interchangeable insert orientation member, which by way of example can be made of plastic. One such insert orientation member 50 is illustrated in FIG. 3. Insert orientation member 50 is a hollow cube which has each of its corner cut off to thereby form an aperture at the corner location. It will be appreciated that a cube having eight corners will therefor have eight such apertures, four of which 52, 54, 56 and 58 are illustrated in FIG. 3. The interior 62 of cut cube 50 is hollow. Movably retained within the interior 62 is selection member 70, which by way of example can be a solid ball such as a marble. Selection member 70 can can free roll within hollow interior 62 of cut cube 50 so that the selection member 70 can land in one of the apertures. In use, the two hemispheres 20 and 30 are opened and approximately one half of insert orientation member 50 is inserted into one of the hemispheres. Thereafter, the second hemisphere is joined and the two hemispheres are press fit shut as previously described, thereby entraping insert orientation member 50 within the interior 40 of now formed hollow sphere 10. Preferably, the insert orientation member 50 is sized to just fit within the interior 40 such that the exterior edges of the cut cube 50 abut the interior surface (either 26 or 36) of the sphere 10. In this manner, the insert orientation member 50 fits snugly within the interior 40 of sphere 10 and cannot move. However, the selection member 70 is free to move within the insert orientation member 50. When the sphere is rolled, comparable to rolling a conventional die, the selection member will randomly fall within one of the apertures of the insert orientation member. In the illustration of FIG. 4, the selection member 70 has fallen into aperture 56. Assuming the sphere 10 is on a level surface, the selection member 70 will fall into an aperture and be at the lowermost point of the sphere 10 when it comes to rest, thereby causing the diametrically opposite area of the sphere to be uppermost. The number at this location, such as area 11, is the number rolled by the spherical die.

Figure 5:
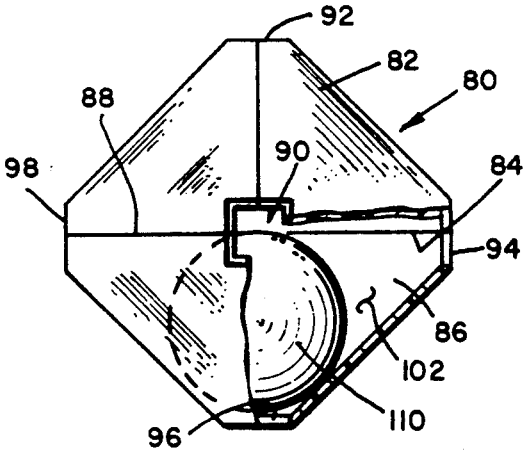
FIG. 5 is a perspective view in partial cross-section, illustrating one alternative embodiment of an insert orientation member which is a pair of four sided pyramids with their bases attached to form an eight sided dual pyramidal figure and with each of the peaks cut off to form apertures, to be used with the present invention spherical die and further illustrating a ball acting as the selection member.
Figure 6:
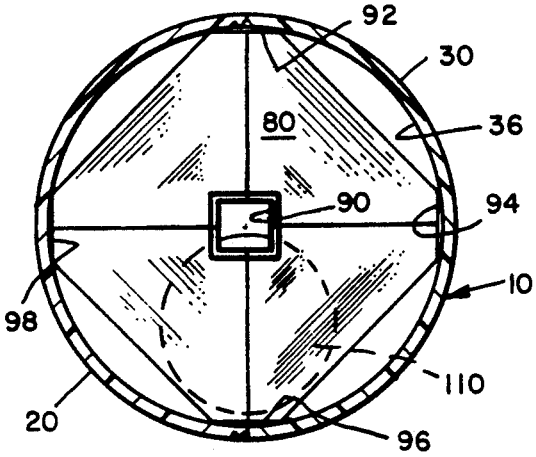
FIG. 6 is a cross-sectional view of the hollow sphere with an elevational view of the insert orientation member of FIG. 5 inserted therein, and further illustrating the selection member in dotted lines having landed in one of the apertures of the insert orientation member.

By removing the insert orientation member 50 and inserting another differently configured insert orientation member such as 80 illustrated in FIG. 5, the odds of certain numbers being rolled can be altered, thereby increasing the complexity and fun of the game. Insert orientation member 80 is a pair of four sided pyramids 82 and 86 with their respective bases 84 and 88 attached to form an eight sided dual pyramidal figure and with each of the peaks cut off to form apertures. It will be appreciated that the eight sided dual pyramidal structure has six peaks and therefore will have six apertures, five of which, 90, 92, 94, 96 and 98 are illustrated in FIG. 5. The interior 102 of cut dual pyramidal structure 80 is hollow. Movably retained within the interior 102 is selection member 110, which by way of example can be a solid ball such as a marble. Selection member 110 can can free roll within hollow interior 102 of cut dual pyramidal structure 80 so that the selection member 110 can land in one of the apertures. In use, the two hemispheres 20 and 30 are opened and approximately one half of insert orientation member 80 is inserted into one of the hemispheres. Thereafter, the second hemisphere is joined and the two hemispheres are press fit shut as previously described, thereby entraping insert orientation member 80 within the interior 40 of now formed hollow sphere 10. Preferably, the insert orientation member 80 is sized to just fit within the interior 40 such that the apertures of cut dual pyramidal structure 80 abut the interior surface (either 26 or 36) of the sphere 10. In this manner, the insert orientation member 80 fits snugly within the interior 40 of sphere 10 and cannot move. However, the selection member 110 is free to move within the insert orientation member 80. When the sphere is rolled, comparable to rolling a conventional die, the selection member will randomly fall within one of the apertures of the insert orientation member. In the illustration of FIG. 6, the selection member 110 has fallen into aperture 96. Assuming the sphere 10 is on a level surface, the selection member 110 will fall into an aperture and be at the lowermost point of the sphere 10 when it comes to rest, thereby causing the diametrically opposite area of the sphere to be uppermost. The number at this location, such as area 15, is the number rolled by the spherical die.

It will be appreciated that depending on the configuration of the insert orientation member, either its edges (as it FIG. 4) or its apertures (as in FIG. 6) or possible portions of both will be adjacent the interior surface of the sphere.

In general any type of multiplicity of marking indicia such as numbers, letters, symbols, etc. or a combination thereof can be used on the surface of the sphere and be selected at random in the manner set forth above.

Therefore, through use of the present interchangeable insert orientation member, the selection of numbers on the surface of the sphere which can come up can be varied and numerous variations to a game of chance can be created. For example, one player will have the insert orientation members and can randomly choose which one to insert while the other player does not know which one has been inserted thereby causing him to guess which insert member has been inserted and therefore guess the probabilities of which numbers can be selected through a roll of the spherical die with unknown insert orientation member therein. Numerous other chance variations can be composed through this invention.

Therefore, the present invention can be defined as a spherical die comprising: (a) a first hemisphere member having an exterior surface, an interior surface and a hollow interior: (b) a second hemisphere member having an exterior surface, an interior surface, and a hollow interior; (c) means for joining said first hemisphere member and said second hemisphere member to form a sphere comprising the first and second hemisphere members, an outer surface comprising the exterior surfaces of the first and second hemisphere members, an interior surface comprising the interior surfaces of the first and second hemisphere members, and a hollow interior; (d) an interchangeable insert orientation member removably inserted within the hollow sphere such that selected locations of the interchangeable insert orientation member abut the interior surface of the sphere; (e) said interchangeable insert orientation member including a multiplicity of apertures at various spaced apart locations; (f) a selection member movably retained within the interchangeable insert orientation member and capable of landing in any one of the apertures when the sphere is rolled; (g) the surface of said sphere including a multiplicity of indicia on its surface, with a given indicia located diametrically opposite to the location of an aperture of said interchangeable insert orientation member; and (h) said interchangeable insert orientation member being removable and a substitute insert orientation member capable of insertion within the hollow interior of the sphere such that selected locations of the interchangeable insert orientation member abut the interior surface of the sphere, with the substitute insert orientation member having a multiplicity of apertures at various spaced apart locations, a selection member movably retained within the substitute interchangeable insert orientation member, and selected indicia on the surface of the sphere corresponding to the apertures in the substitute interchangeable insert orientation member such that a given indicia is diametrically opposite to the location of an aperture of the substitute interchangeable insert orientation member; (i) whereby a user can roll the die and the selection member will land in a given aperture and cause the sphere to come to rest in a position where the selected indicia on the surface of the sphere is diametrically opposite to the aperture of the interchangeable insert orientation member into which the selection member has landed and the random selection of indicia which can come up can be varied by substituting the substitute interchangeable insert orientation member in the sphere.

Defined more broadly, the present invention is a spherical die comprising: (a) a hollow sphere having two interlocked halves and openable to expose the hollow interior; (b) an interchangeable insert orientation member removably inserted within the hollow sphere; (c) said interchangeable insert orientation member including a multiplicity of apertures at various spaced apart locations; (d) a selection member movably retained within the interchangeable insert orientation member and capable of landing in any one of the apertures when the sphere is rolled; and (e) the surface of said sphere including a multiplicity of indicia on its surface, with a given indicia located diametrically opposite to the location of an aperture of said interchangeable insert orientation member; (f) whereby a user can roll the die and the selection member will land in a given aperture and cause the sphere to come to rest in a position where the selected indicia on the surface of the sphere is diametrically opposite to the aperture of the interchangeable insert orientation member into which the selection member has landed.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. A spherical die comprising:

a. a first hemisphere member having an exterior surface, an interior surface and a hollow interior;

b. a second hemisphere member having an exterior surface, an interior surface, and a hollow interior;

c. means for joining said first hemisphere member and said second hemisphere member to form a sphere comprising the first and second hemisphere members, an outer surface comprising the exterior surfaces of the first and second hemisphere members, an interior surface comprising the interior surfaces of the first and second hemisphere members, and a hollow interior;

d. an interchangeable insert orientation member removably inserted within the hollow sphere such that selected locations of the interchangeable insert orientation member abut the interior surface of the sphere;

e. said interchangeable insert orientation member including a multiplicity of apertures at various spaced apart locations;

f. a selection member movably retained within the interchangeable insert orientation member and capable of landing in any one of the apertures when the sphere is rolled;

g. the surface of said sphere including a multiplicity of indicia on its surface, with a given indicia located diametrically opposite to the location of an aperture of said interchangeable insert orientation member; and h. said interchangeable insert orientation member being removable and a substitute insert orientation member capable of insertion within the hollow interior of the sphere such that selected locations of the interchangeable insert orientation member abut the interior surface of the sphere, with the substitute insert orientation member having a multiplicity of apertures at various spaced apart locations, a selection member movably retained within the substitute interchangeable insert orientation member, and selected indicia on the surface of the sphere corresponding to the apertures in the substitute interchangeable insert orientation member such that a given indicia is diametrically opposite to the location of an aperture of the substitute interchangeable insert orientation member;

i. whereby a user can roll the die and the selection member will land in a given aperture and cause the sphere to come to rest in a position where the selected indicia on the surface of the sphere is diametrically opposite to the aperture of the interchangeable insert orientation member into which the selection member has landed and the random selection of indicia which can come up can be varied by substituting the substitute interchangeable insert orientation member in the sphere.

2. The spherical die in accordance with claim 1 wherein said first hemisphere and second hemisphere are joined through mating threads.

3. The spherical die in accordance with claim 1 wherein said first hemisphere and said second hemisphere are made of plastic.

4. The spherical die in accordance with claim 1 wherein each interchangeable insert orientation member is made of plastic.

5. The spherical die in accordance with claim 1 wherein said selection member for each interchangeable insert orientation member is a marble.

6. The spherical die in accordance with claim 1 wherein said multiplicity of indicia are a multiplicity of numbers.

7. The spherical die in accordance with claim 1 wherein each interchangeable insert orientation member is a hollow cube with its corners cut off to form the apertures.

8. The spherical die in accordance with claim 1 wherein each interchangeable insert orientation member comprises two, four-sided, hollow pyramids which are attached at their bases at wherein said member has its six peaks cut off to form the apertures.

9. A spherical die comprising:

a. a first hemisphere member having an exterior surface, an interior surface and a hollow interior;

b. a second hemisphere member having an exterior surface, an interior surface, and a hollow interior;

c. means for joining said first hemisphere member and said second hemisphere member to form a sphere comprising the first and second hemisphere members, an outer surface comprising the exterior surfaces of the first and second hemisphere members, an interior surface comprising the interior surfaces of the first and second hemisphere members, and a hollow interior;

d. an interchangeable insert orientation member removably inserted within the hollow sphere such that selected locations of the interchangeable insert orientation member abut the interior surface of the sphere;

e. said interchangeable insert orientation member including a multiplicity of apertures at various spaced apart locations;

f. a selection member movably retained within the interchangeable insert orientation member and capable of landing in any one of the apertures when the sphere is rolled; and g. the surface of said sphere including a multiplicity of indicia on its surface, with a given indicia located diametrically opposite to the location of an aperture of said interchangeable insert orientation member;

h. whereby a user can roll the die and the selection member will land in a given aperture and cause the sphere to come to rest in a position where the selected indicia on the surface of the sphere is diametrically opposite to the aperture of the interchangeable insert orientation member into which the selection member has landed.

10. The spherical die in accordance with claim 9 wherein said first hemisphere and second hemisphere are joined through mating threads.

11. The spherical die in accordance with claim 9 wherein said first hemisphere and said second hemisphere are made of plastic.

12. The spherical die in accordance with claim 9 wherein said interchangeable insert orientation member is made of plastic.

13. The spherical die in accordance with claim 9 wherein said selection member for the interchangeable insert orientation member is a marble.

14. The spherical die in accordance with claim 9 wherein said multiplicity of indicia are a multiplicity of numbers.

15. The spherical die in accordance with claim 9 wherein said interchangeable insert orientation member is a hollow cube with its corners cut off to form the apertures.

16. The spherical die in accordance with claim 9 wherein said interchangeable insert orientation member comprises two, four-sided, hollow pyramids which are attached at their bases and wherein said member has its six peaks cut off to form the apertures.

17. A spherical die comprising:

a. a hollow sphere having two interlocked halves and openable to expose the hollow interior;

b. an interchangeable insert orientation member removably inserted within the hollow sphere;

c. said interchangeable insert orientation member including a multiplicity of apertures at various spaced apart locations;

d. a selection member movably retained within the interchangeable insert orientation member and capable of landing in any one of the apertures when the sphere is rolled; and e. the surface of said sphere including a multiplicity of indicia on its surface, with a given indicia located diametrically opposite to the location of an aperture of said interchangeable insert orientation member;

f. whereby a user can roll the die and the selection member will land in a given aperture and cause the sphere to come to rest in a position where the selected indicia on the surface of the sphere is diametrically opposite to the aperture of the interchangeable insert orientation member into which the selection member has landed.

18. A spherical die in accordance with claim 17, wherein said interchangeable insert orientation member is removable and a substitute insert orientation member is capable of insertion within the hollow interior of the sphere, with the substitute insert orientation member having a multiplicity of apertures at various spaced apart locations, a selection member movably retained within the substitute interchangeable insert orientation member, and selected indicia on the surface of the sphere corresponding to the apertures in the substitute interchangeable insert orientation member such that a given indicia is diametrically opposite to the location of an aperture of the substitute interchangeable insert orientation member; whereby a user can roll the die and the selection member will land in a given aperture and cause the sphere to come to rest in a position where the selected indicia on the surface of the sphere is diametrically opposite to the aperture of the interchangeable insert orientation member into which the selection member has landed and the random selection of indicia which can come up can be varied by substituting the substitute interchangeable insert orientation member in the sphere.

* * * * *